US007742722B2

(12) United States Patent
Shiga et al.

(10) Patent No.: US 7,742,722 B2
(45) Date of Patent: Jun. 22, 2010

(54) IMAGE FORMING APPARATUS

(75) Inventors: Yuki Shiga, Osaka (JP); Yukihiro Itoh, Osaka (JP)

(73) Assignee: Kyocera Mita Corporation (JP)

( * ) Notice: Subject to any disclaimer, the term of this patent is extended or adjusted under 35 U.S.C. 154(b) by 427 days.

(21) Appl. No.: 11/977,190

(22) Filed: Oct. 24, 2007

(65) Prior Publication Data

US 2008/0101826 A1 May 1, 2008

(30) Foreign Application Priority Data

Oct. 25, 2006 (JP) ..... 2006-289750

(51) Int. Cl.
*G03G 15/20* (2006.01)

(52) U.S. Cl. ..... 399/122; 399/320; 399/110; 219/216

(58) Field of Classification Search ..... 399/122, 399/320, 110; 219/216
See application file for complete search history.

(56) References Cited

U.S. PATENT DOCUMENTS 5,528,345 A 6/1996 Hasegawa
6,498,911 B2 * 12/2002 Hiroki et al. ..... 399/69
2003/0099476 A1 * 5/2003 Minakuchi et al. ..... 399/21
2005/0158075 A1 * 7/2005 Echigo et al. ..... 399/122
2006/0056890 A1 * 3/2006 Aze et al. ..... 399/329

FOREIGN PATENT DOCUMENTS

JP 2002-311729 10/2002

* cited by examiner

*Primary Examiner*—David M Gray
*Assistant Examiner*—G. M. Hyder
(74) *Attorney, Agent, or Firm*—Gerald E. Hespos; Michael J. Porco

(57) ABSTRACT

An image forming apparatus is provided with a main body, an image forming assembly accommodated in the main body, a withdrawable unit accommodated in the main body in such a manner as to be withdrawable to the outside, a fixing unit for fixing a toner image to a recording sheet with heat from the heating member by conveying the recording sheet having the toner image transferred thereto while nipping it between a heating member and the pressure member, and a temperature raising device for raising the temperature of the heating member. The fixing unit is detachably mounted on the withdrawable unit. On the other hand, the temperature raising device includes a mounting portion different from that of the heating member, and is fixedly attached to the withdrawable unit and is kept attached to the withdrawable unit even if the fixing unit is separated from the withdrawable unit.

7 Claims, 12 Drawing Sheets

IMAGE FORMING APPARATUS

BACKGROUND OF THE INVENTION

1. Field of the Invention

The present invention relates to an image forming apparatus such as a printer, a copier, a facsimile machine or a complex machine, and particularly to a construction of a fixing unit for fixing a toner image, which has been transferred to a sheet, to the sheet.

2. Description of the Related Art

A fixing unit of an image forming apparatus is adapted for fixing a toner image to a sheet by conveying the sheet having an unfixed toner image transferred thereto through a nip between a heating roller and a pressure roller while heating the unfixed toner image by means of the heating roller. In order to increase the temperature of the outer surface of the heating roller, an induction heating method for causing the heating roller to generate heat itself is adopted in addition to a radiant heating method according to which a heat source such a halogen lamp is installed in the heating roller. By this induction heating method, the temperature of the heating roller can be quickly increased by an eddy current resulting from electromagnetic induction.

As a prior art relating to a fixing unit adopting the induction heating method, a construction is known in which a bobbin having an induction heating function is installed in a cylindrical heating roller (see, for example, Japanese Unexamined Patent Publication No. 2002-311729). The bobbin also has a cylindrical shape and an induction coil, a ferrite core and the like are arranged therein. Since the heating roller and the bobbin are separate parts and wiring with the induction coil is arranged in the bobbin, the heating roller can freely rotate. Particularly in this prior art, one end of the bobbin is connected with one side wall plate of a main body of an image forming apparatus. Thus, upon detaching the fixing unit, the bobbin remains in the main body of the image forming apparatus. Therefore, the fixing unit is thought to be able to be easily disassembled and reassembled at the time of replacing the heating roller.

However, in the prior art construction in which the bobbin remains in the main body of the image forming apparatus, a circuit board and the like for supplying a current to the coil also remains in the main body together with the bobbin. Thus, for the maintenance, inspection and the like of the circuit board, an operator has to detach, replace and/or attach the circuit board while stretching his arms to the back of the main body of the image forming apparatus after the fixing unit is detached. Such an operation is particularly difficult if a space after the detachment of the fixing unit is small.

SUMMARY OF THE INVENTION

An object of the present invention is to improve operability in the maintenance, inspection and the like of a fixing unit.

One aspect of the present invention seeking to accomplish the above object is directed to an image forming apparatus, comprising a main body; an image forming assembly accommodated in the main body and adapted for forming a toner image based on an image data and transferring the toner image to a recording sheet; a withdrawable unit accommodated in the main body in such a manner as to be withdrawable to the outside; a fixing unit detachably mounted on the withdrawable unit, including a heating member and a pressure member held in contact with the heating member with a specified pressing force and adapted for fixing the toner image to the recording sheet with heat from the heating member by conveying the recording sheet having the toner image transferred thereto while nipping it between the heating member and the pressure member; and a temperature raising device located in the vicinity of the heating member to raise the temperature of the heating member when the fixing unit is mounted on the withdrawable unit. The temperature raising device includes a mounting portion different from that of the heating member, being fixedly attached to the withdrawable unit and kept attached to the withdrawable unit even if the fixing unit is separated from the withdrawable unit.

It may be preferable that the heating member is a heating rotary member and the pressure member is a pressure rotary member. The pressure member forms a nip portion by being brought into contact with the heating rotary member with a specified pressing force and conveys the recording sheet having the toner image transferred thereto while nipping it in the nip portion.

Preferably, the temperature raising device may include a coil holding member holding an induction coil for causing the heating member to generate an induction current.

These and other objects, features, aspects and advantages of the present invention will become more apparent upon a reading of the following detailed description with reference to accompanying drawings.

DETAILED DESCRIPTION OF THE PREFERRED EMBODIMENTS

Hereinafter, best modes for embodying the present invention are described in detail with reference to the accompanying drawings.

First Embodiment

Figure 1:
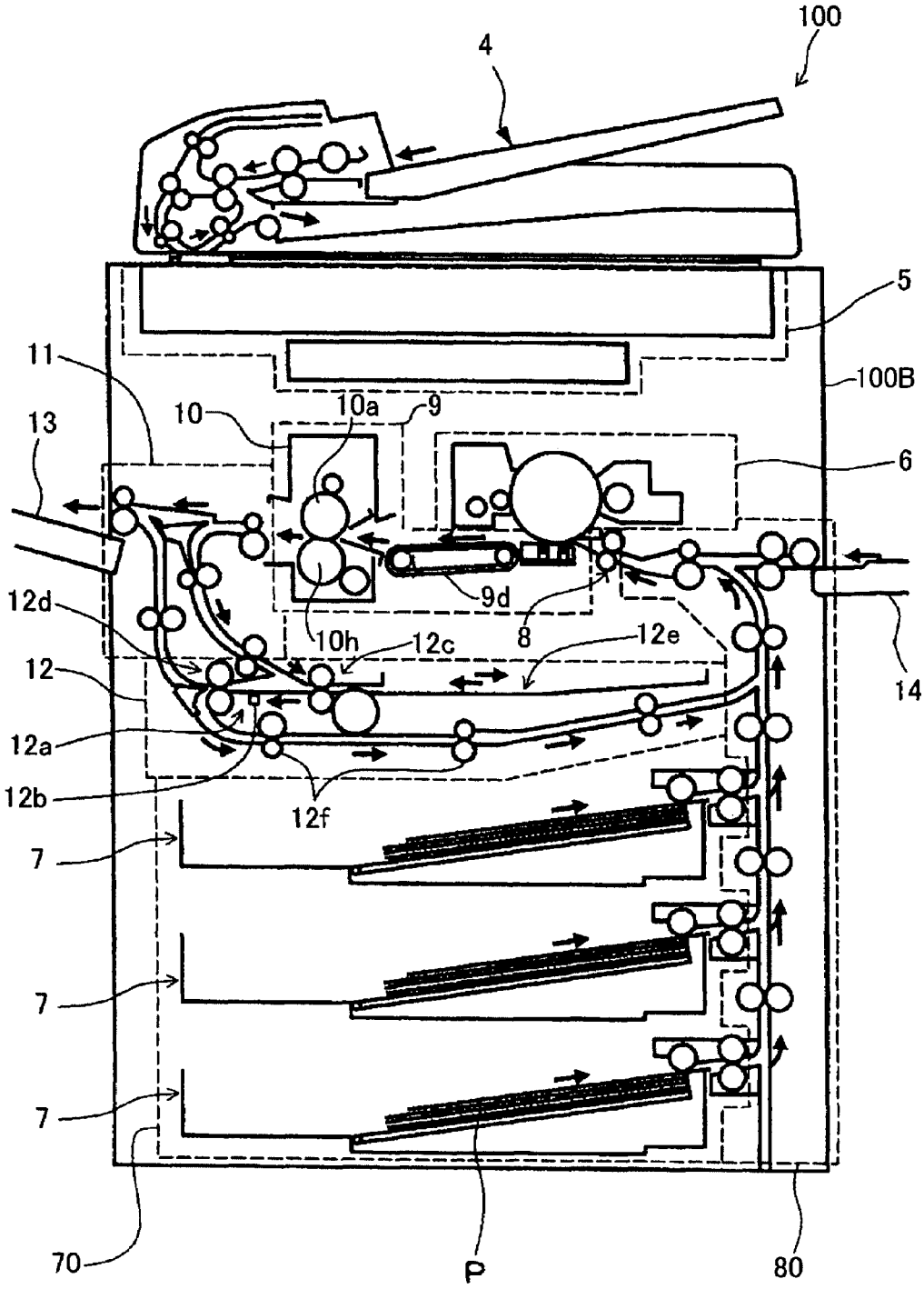
FIG. 1 is a schematic sectional view showing a construction of an image forming apparatus according to an embodiment of the invention.

FIG. 1 is a schematic diagram showing a construction of an image forming apparatus 100 according to an embodiment of the invention. The image forming apparatus 100 has a function such as a copier, a facsimile transceiver, a complex machine or a multi-function peripheral (MFP). The image forming apparatus 100 is provided with a main body 100B, a document feeder 4 arranged atop the main body 100B and an optical reader 5 arranged at a corresponding position below the document feeder 4. A user places a document having an image such as characters, figures and patterns on the document reader 4 in the case of copying or facsimile-transmitting the document. If there are a plurality of documents, the documents are separated and fed one by one in the document feeder 4 to have images thereof read by the optical reader 5.

The image forming apparatus 100 is provided with an image forming assembly 6 accommodated in the main body 100B. The image forming assembly 6 forms an image based on an image data, which is a processed data of an image read by the optical reader 5, or an image data received through a network. Specifically, the image forming assembly 6 causes an electrostatic latent image to be formed on the outer surface of a photoconductive drum provided therein, and causes a toner image to be formed by developing this electrostatic latent image with toner.

The image forming apparatus 100 is also provided with a sheet feeder 70 at the bottom of the main body 100B. The sheet feeder 70 includes three sheet cassettes 7 arranged one above another. The sheet cassettes 7 are of the so-called front loading type, and the individual sheet cassettes 7 can be all slid forward (front side in FIG. 1) of the image forming apparatus 100 to be withdrawn. Sheets P such as cut papers before printing are stacked in each sheet cassette 7. Sheets P stacked in the sheet cassettes 7 are separated and fed one by one from the sheet feeder 70.

Sheets of different sizes and different types can be set at the respective positions of the upper, middle and lower sheet cassettes 7. For example, the uppermost sheet cassette 7 is set for multipurpose uses and OHP sheets, thick paper, thin paper and the like can be accommodated therein. A4 plain paper having a relatively high frequency in use can be accommodated in the middle sheet cassette 7, and large-size sheets can be accommodated in the bottommost sheet cassette 7. The sizes and types of the sheets accommodated in the sheet cassettes 7 at the respective levels can be set in the image forming apparatus 100 beforehand.

A manual sheet feeder 14 is provided to project laterally to right from the right surface of the main body 100B. Sheets P of the sizes not accommodated in the sheet feeder 70 and sheets to be singly fed such as OHP sheets are to be placed on the manual sheet feeder 14. It should be noted that the manual sheet feeder 14 may be folded onto the right surface of the main body 100B to be accommodated.

The image forming apparatus 100 is provided with a sheet conveyance assembly 80 at the right side of the main body 100B thereof. The sheet conveyance assembly 80 is located to the right of the sheet feeder 70 in a sheet feeding direction. A sheet P fed from the sheet feeder 70 is conveyed vertically upward along the side surface of the main body 100B by the sheet conveyance assembly 80. A sheet P fed from the manual sheet feeder 14 is horizontally conveyed.

The image forming apparatus 100 is provided with a pair of registration rollers 8 for feeding the sheet conveyed by the sheet conveyance assembly 80 to the image forming assembly 6. The pair of registration roller 8 are for correcting an oblique feed of the sheet P and for synchronizing the feed of the sheet P toward the image forming assembly 6 with the formation of a toner image in the image forming assembly 6. In the image forming assembly 6, the toner image is transferred to the sheet P from the outer surface of the photoconductive drum.

The image forming apparatus 100 is also provided with a conveyance unit (withdrawable unit) 9 extending from a position below the image forming assembly 6 to a position to the right of the image forming assembly 6. The conveyance unit 9 conveys the sheet P having the toner image transferred thereto in the image forming assembly 6 toward a fixing unit 10.

The fixing unit 10 includes a heating roller 10*a* (heating member: heating rotary member) and a pressure roller 10*b* (pressure member: pressure rotary member) for forming a nip portion by being brought into contact with the heating roller 10*a* with a specified pressing force. In the fixing unit 10, the sheet P is conveyed through the nip portion pressed while being pressed and heated by nipping, thereby fixing the toner image to the sheet P. It should be noted that the fixing unit 10 is structurally incorporated into the conveyance unit 9 in this embodiment.

The image forming apparatus 100 is further provided with a discharging/branching assembly 11 at a position adjacent to the conveyance unit 9. In the case where image duplex printing is not performed (in the case of simplex printing), the sheet P conveyed through the fixing unit 10 by the conveyance unit 9 is directly discharged onto a sheet receiving tray 13 outside the main body 100B from the discharging/branching assembly 11.

The image forming apparatus 100 is further provided with a duplex printing unit (duplex printing mechanism) 12. In the case of performing duplex printing in the image forming apparatus 100, the sheet P discharged from the conveyance unit 9 is conveyed to the duplex printing unit 12 via the discharging/branching assembly 11. The sheet P conveyed to the duplex printing unit 12 has successively a conveying direction thereof switched by a sheet reversing device 12*a* provided in the duplex printing unit 12, and is conveyed to the image forming assembly 6 again via the sheet conveyance assembly 80 and the pair of registration rollers 8.

The sheet reversing device 12*a* includes a switchback mechanism 12*c* and a shifting mechanism 12*d*. The switchback mechanism 12*c* is adapted for reversing the conveying direction of the sheet P. The shifting mechanism 12*d* is adapted for correcting a displacement of the sheet P in width direction. At a position closer to the discharging/branching assembly 11 than the shifting mechanism 12*d* in the sheet conveying direction is provided a sensor 12*b* for detecting a displacement of the sheet P in a width direction.

At a side closer to the image forming assembly 6 than the switchback mechanism 12*c* in a sheet entering direction into the sheet reversing device 12*a* is disposed an intermediate tray 12*e*. The sheet P having one side thereof printed is temporarily accommodated in this intermediate tray 12*e*. The switchback mechanism 12*c* conveys the sheet in the opposite direction to switch the conveying direction after temporarily accommodating the sheet P in the intermediate tray 12*e*.

After being position-corrected by the shifting mechanism 12*d*, the switched-back sheet P is so reversed as to move downward at a position downstream of the shifting mechanism 12*d* in the conveying direction. Then, the sheet P reaches the sheet conveyance assembly 80 while moving slightly obliquely upward after being fed to the right by a plurality of conveyance rollers 12*f* below the image forming assembly 6. In this way, the sheet P is fed to the image forming assembly 6 with the already printed side faced down to have the opposite side thereof printed. The sheet P having both sides printed is discharged onto the sheet receiving tray 13 via the discharging/branching assembly 11. Alternatively, the sheet P is conveyed upward along the left part of the main body 100B to be discharged onto the sheet receiving tray 13 after being reversed again by the sheet reversing device 12*a*.

An operation of copying documents is performed in the above-constructed image forming apparatus 100 as follows.

First, in an imaging process accompanying copying of documents, a user depresses a start button of an unillustrated operation unit with documents placed on the document feeder 4. Then, the following process is performed in response to the above operation. First, when a sheet sensor (not shown) built in the document feeder 4 detects a document sheet, the documents are fed one by one by the document feeder 4 and have images thereof scanned by the optical reader 5 while being fed. Image data read at this time are stored as one job by an unillustrated controller.

The controller applies image processings corresponding to various settings after applying pre-processings such as noise removal from images to the image data, and feeds the processed data page by page to the image forming assembly 6. In this way, an electrostatic latent image is formed on the outer surface of the photoconductive drum of the image forming assembly 6 and developed with toner.

On the other hand, in the image forming apparatus 100, a sheet P dispensed from the sheet feeder 70 is fed to the pair of registration rollers 8 and temporarily stopped thereat. When the photoconductive drum of the image forming assembly 6 reaches a specified angle of rotation, the sheet P is conveyed again by the pair of registration rollers 8 at this timing, whereby a toner image is transferred to the sheet P.

If duplex printing is set for the job this time, the sheet P having the toner image transferred thereto has the conveying direction of moving downward in the discharging/branching assembly 11 after being heated and pressed in the fixing unit 10 and is consequently fed toward the duplex printing unit 12.

Figure 2:
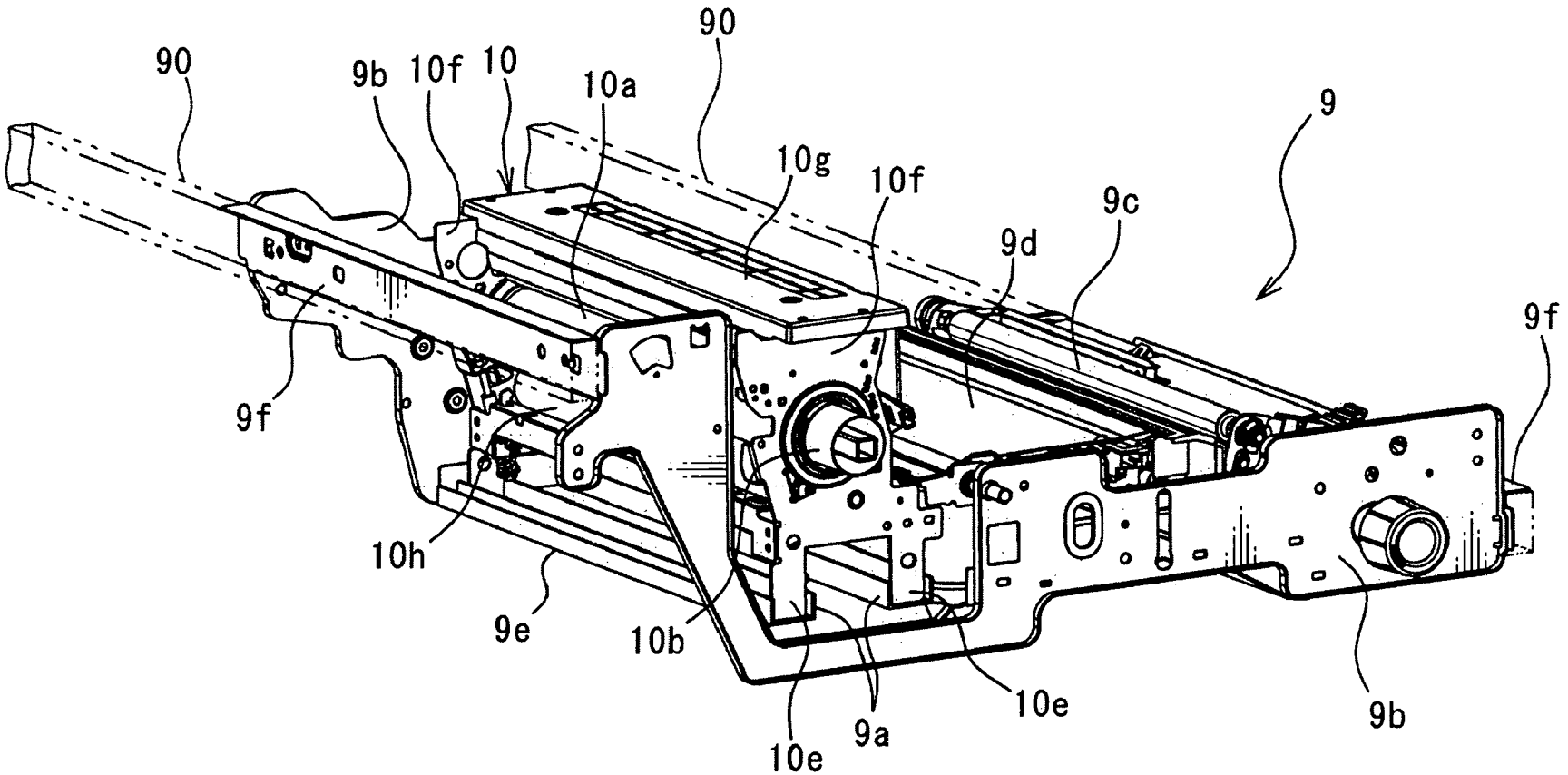
FIG. 2 is a perspective view of a conveyance unit.

Next, the conveyance unit 9 and the fixing unit 10 are described in detail. FIG. 2 is a perspective view showing a construction of the conveyance unit 9. In FIG. 2, an oblique downward direction is a forward direction of the main body 100B. Conversely, an oblique upward direction is a backward direction of the main body 100B. Although the conveyance unit 9 is singly shown here, it is supported on the main body 100B of the image forming apparatus 100, for example, via two slide rails 90. These slide rails 90 are, for example, telescopic direct drive guides, and the user can withdraw the conveyance unit 9 forward from the main body 100B and push it into the main body 100B using these slide rails 90. It should be noted that the user can insert and withdraw the conveyance unit 9 with an outer cover (not shown) covering the front surface of the main body 100B opened.

Thus, the conveyance unit 9 can slide to project from the main body 100B in a direction (forward direction here) normal to the sheet conveying direction. Accordingly, an operation for the maintenance, inspection and jammed sheet removal of the image forming apparatus 100 can be easily performed by withdrawing the conveyance unit 9 to the outside the main body 100B.

The conveyance unit 9 includes two frame plates 9*b* paired at front and back sides in a sliding direction thereof. These frame plates 9*b* are arranged in parallel while being spaced apart by a specified distance, and are coupled to each other via two coupling members 9*f*. These coupling members 9*f* are located at the opposite left and right ends of the conveyance unit 9 and extend in forward and backward directions. The two slide rails 90 are so mounted as to extend along the outer surfaces of the respective coupling members 9*f*. The conveyance unit 9 also has a bottom plate 9*e*, which also horizontally extends to couple the front and back frame plates 9*b*.

A conveyance roller 9*c* and a conveyance belt 9*d* are arranged between the front and back frame plates 9*b*. The conveyance roller 9*c* conveys a sheet having a toner image transferred thereto in the image forming assembly 6 toward the conveyance belt 9*d*. Further, the conveyance belt 9*d* travels while bearing the sheet having the toner image transferred thereto, and conveys this sheet to the fixing unit 10.

The fixing unit 10 is arranged on the bottom plate 9*e* of the conveyance unit 9. The fixing unit 10 conveys the sheet while heating and pressing it upon receiving the sheet from the conveyance belt 9*d*, thereby fixing the toner image to the sheet.

In this embodiment, the fixing unit 10 is structurally roughly divided into two parts. One part is a main body including the heating roller 10*a* and the pressure roller 10*h*, and the other part is a coil shaft 10*b* (coil holding member: temperature raising device) arranged inside the heating roller 10*a*. Out of these, the main body includes, in addition to the heating roller 10*a* and the pressure roller 10*h*, supporting plates 10*f* for rotatably supporting the heating roller 10*a* and the pressure roller 10*h* and a cleaner 10*g* for cleaning the outer surface of the heating roller 10*a*. A pair of front and back supporting plates 10*f* are arranged at the opposite sides of a sheet conveyance path, and the cleaner 10*g* is so mounted above the heating roller 10*a* as to connect these supporting plates 10*a*. The opposite ends of the heating roller 10*a* are passed through the supporting plates 10*f* and are rotatably supported on the outer circumferences thereof.

Two guide rails 9*a* are arranged in parallel on the bottom plate 9*e* of the conveyance unit 9. These guide rails 9*a* extend in directions (forward and backward directions of the image forming apparatus 100) normal to the sheet conveyance path and has a uniform groove-shaped (U-shaped) cross section. Two legs 10*e* are formed at the bottom end of each supporting plate 10*f* of the fixing unit 10. These legs 10*e* are in such a positional relationship as to be closely fitted in the grooves of the respective guide rails 9*a*. In this state, the main body of the fixing unit 10 can slide in the directions (forward and backward directions of the image forming apparatus 100) normal to the sheet conveying direction along the guide rails 9*a*.

Figure 3:
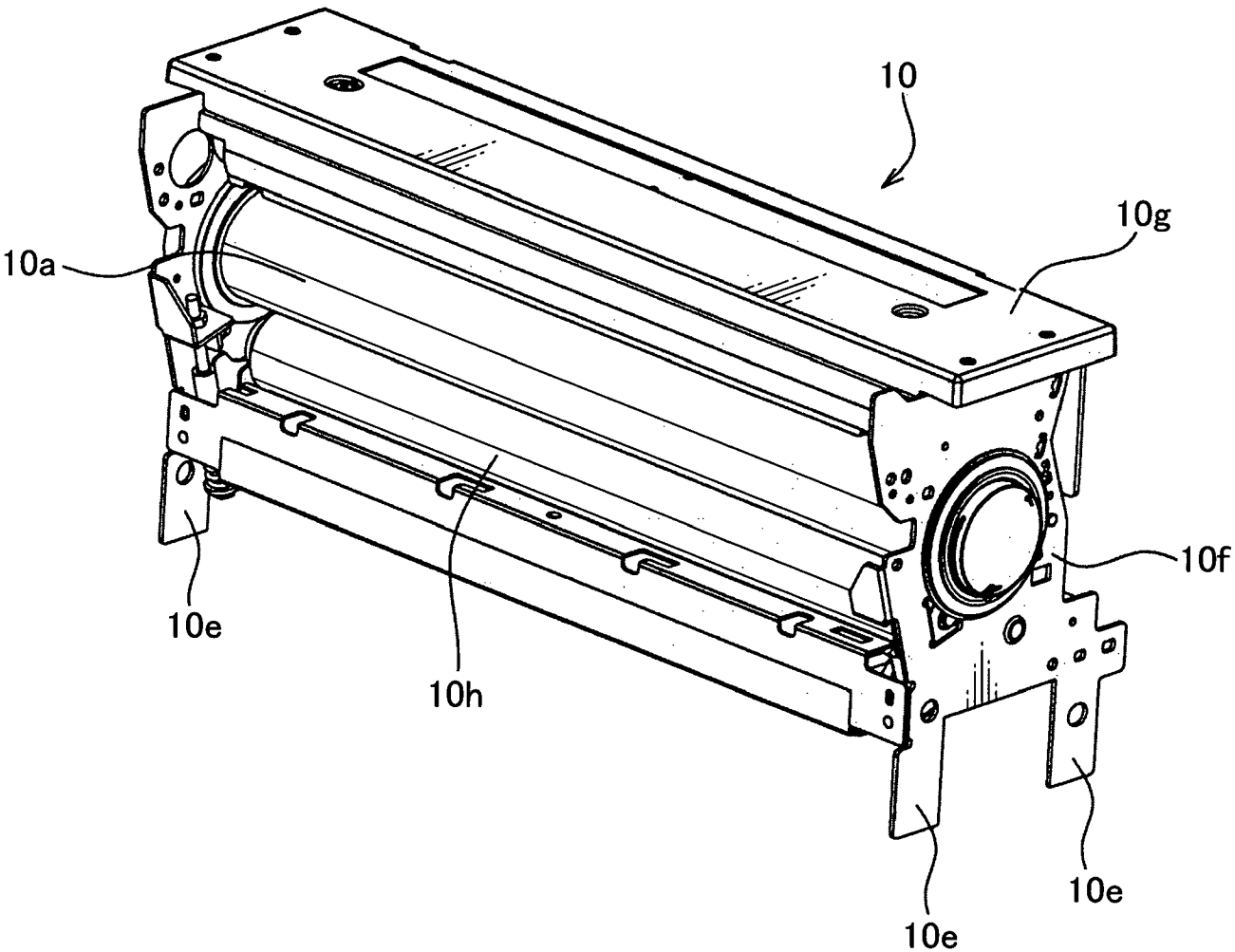
FIG. 3 is a perspective view showing a main body of a fixing unit without a coil shaft.

FIG. 3 is a perspective view showing only the main body of the fixing unit 10. The main body of the fixing unit 10 is separate from the coil shaft 10*b* and can be detached further forward of the conveyance unit 9 (forward of the image forming apparatus 100). At this time, the main body is slid while being guided by the guide rails 9*a* as described above. Since the heating roller 10*a*, the pressure roller 10*h*, the cleaner 10*g* and the like are constructed in the conventional manner, they are not described in detail here.

Figure 4:
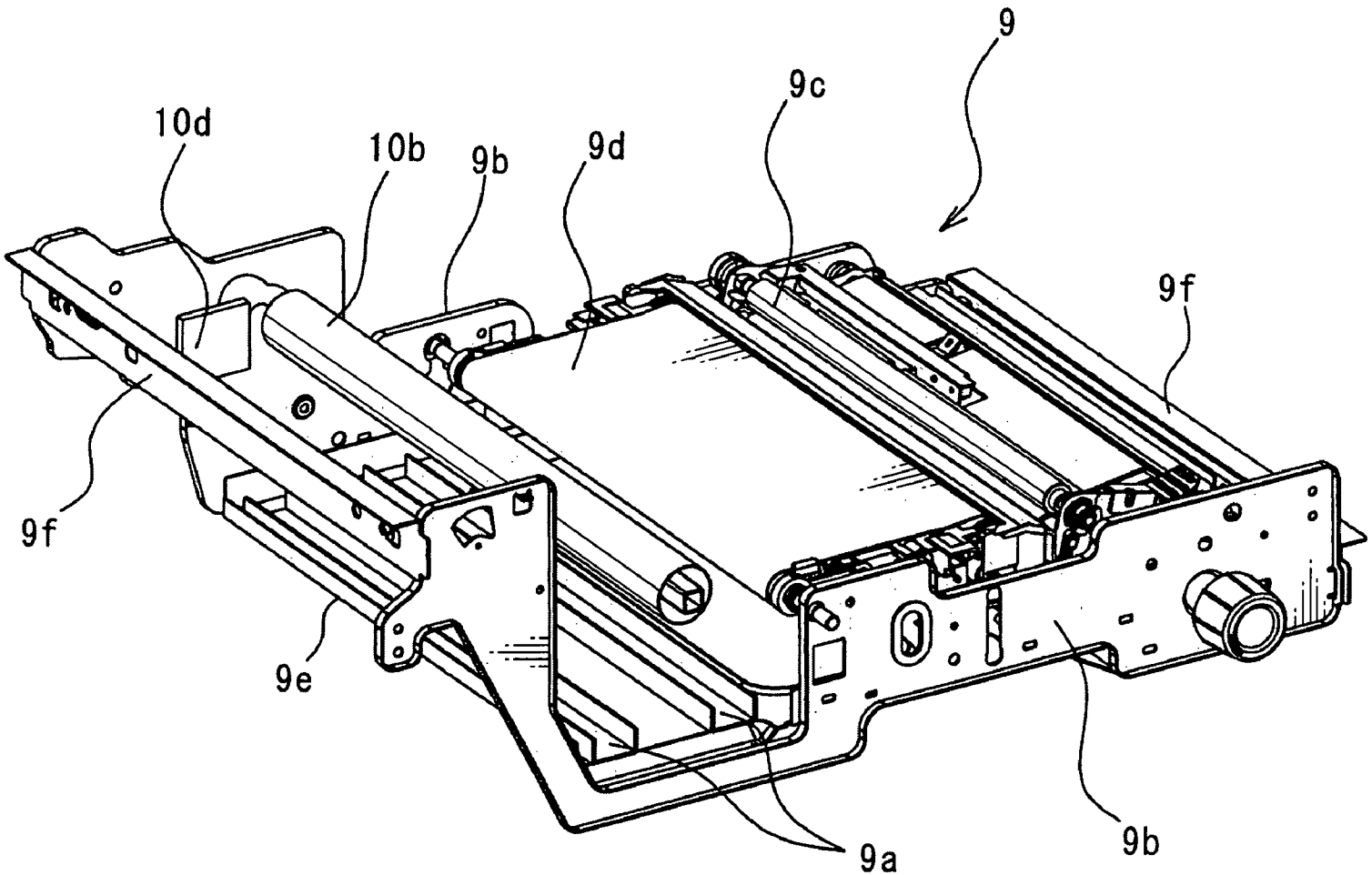
FIG. 4 is a perspective view of the conveyance unit with the main body of the fixing unit detached.
Figure 5:
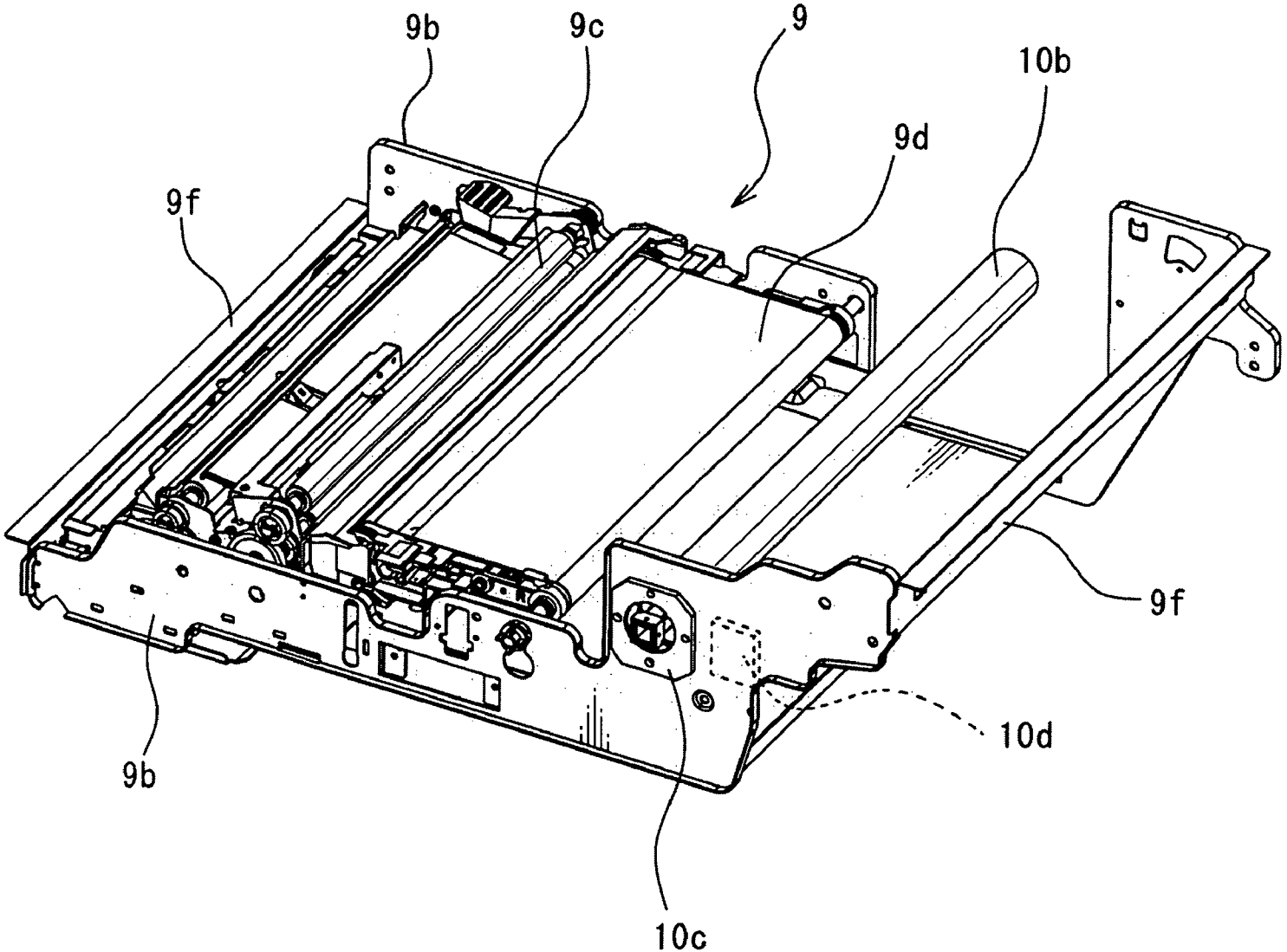
FIG. 5 is a perspective view showing the conveyance unit from the back of the image forming apparatus.

FIG. 4 is a perspective view showing the conveyance unit 9 with the main body of the fixing unit 10 detached, and FIG. 5 is a perspective view showing the conveyance unit 9 from the back of the image forming apparatus 100. In FIG. 5, an oblique upward direction is the forward direction of the image forming apparatus 100. Conversely, an oblique downward direction is the backward direction of the image forming apparatus 100.

When the main body of the fixing unit 10 is detached, the coil shaft 10*b* of the fixing unit 10 remains in the conveyance unit 9. More specifically, the coil shaft 10*b* has a base end 10*c* thereof fixedly attached to the back frame plate 9*b* and extends in the direction normal to the sheet conveying direction from this base end 10*c*. The coil shaft 10*b* has a narrow and long cylindrical shape and electrical components such as an induction coil and a ferrite core are arranged therein although not shown in detail in FIGS. 4 and 5.

In this embodiment, a circuit board 10*d* (current supplying portion) is mounted on the back frame plate 9*b* of the conveyance unit 9. The circuit board 10*d* is formed with an electric circuit (e.g. inverter) for supplying a high-frequency current. Although the circuit board 10*d* is arranged near the base end 10*c* of the coil shaft 10*b* in this example, the position of the circuit board 10*d* is not particularly limited to the shown one.

If the conveyance unit 9 is withdrawn forward of the image forming apparatus 100 at the time of an operation for the maintenance or inspection, the circuit board 10*d* is also withdrawn forward of the image forming apparatus 100. If the main body of the fixing unit 10 is detached from the conveyance unit 9, the circuit board 10*d* and its wiring are exposed together with the coil shaft 10*b* as shown in FIGS. 4 and 5.

At the time of an operation for a regular maintenance or inspection or the replacement of a certain part in the image forming apparatus 100 provided with the conveyance unit 9 and the fixing unit 10 constructed as above, an operator may perform the operation to the coil shaft 10*b* and the circuit board 10*d*, for example, in the following procedure.

Figure 6:
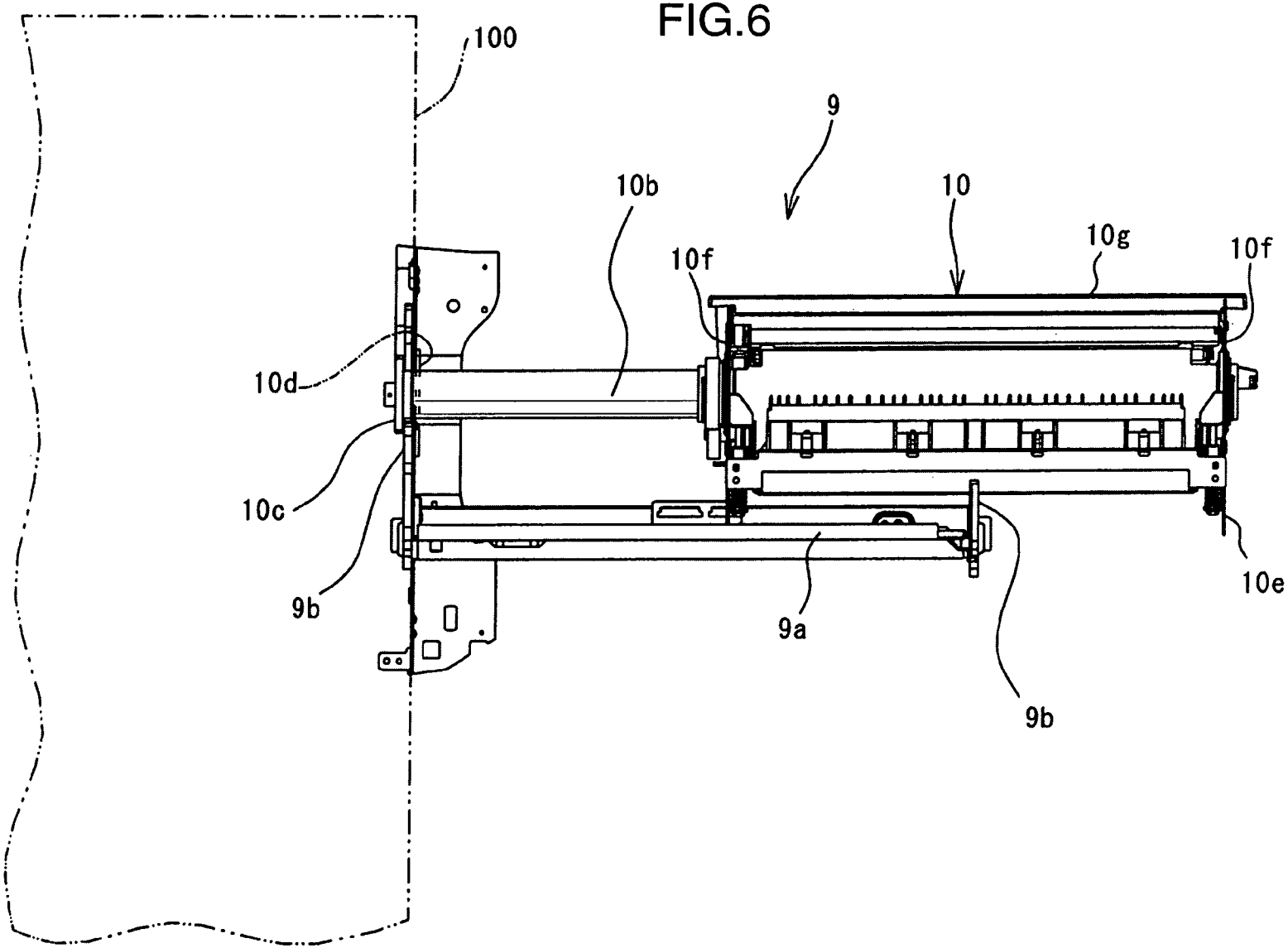
FIG. 6 is a left side view showing a state where the conveyance unit and the fixing unit are withdrawn from the image forming apparatus.

FIG. 6 is a diagram showing a state where the conveyance unit 9 and the fixing unit 10 are withdrawn to the outside from the image forming apparatus 100 when viewed from the sheet receiving tray 13 (from the left side of the image forming apparatus 100). First of all, the operator cuts off the power supply to the image forming apparatus 100 and opens the unillustrated outer cover at front.

Subsequently, the operator grips the conveyance unit 9 and pulls it forward to the outside of the main body 100B of the image forming apparatus 100. At this time, the conveyance unit 9 is slid while being smoothly guided by the above slide rails 90.

In this pulled-out state, the operator can easily manually detach or disassemble the respective exposed parts such as the conveyance roller 9*c* and the conveyance belt 9*d* or remove a jammed sheet.

Then, the operator detaches the main body of the fixing unit 10 from the coil shaft 10*b* while sliding the fixing unit 10 forward. Since the legs 10*e* are guided along the aforementioned guide rails 9*a* at this time, the operator can easily detach the main body of the fixing unit 10. If the main body of the fixing unit 10 is detached in this way, the coil shaft 10*b* and the circuit board 10*d* remain in the conveyance unit 9. In this case, the operator can easily perform the operation for the maintenance, the inspection and the like to the exposed coil shaft 10*b* and circuit board 10*d* while looking at them closely.

On this point, in the construction in which the coil shaft 10*b* and the circuit board 10*d* remain in the main body 100B of the image forming apparatus 100, the operation cannot be performed unless the operator stretches his arms behind the conveyance unit 9 after the conveyance unit 9 is withdrawn and feels for the coil 10*b* and the circuit board 10*d*. On the contrary, this embodiment is very useful in enabling the operation to be easily performed while the coil shaft 10*b* and the circuit board 10*d* are directly looked at.

Further, in the construction in which the coil shaft 10*b* remains in the main body 100B of the image forming apparatus 100 as described above, it is also possible to mount only the circuit board 10*d* in the conveyance unit 9. However, such a construction is inconvenient since it requires the wiring to be elongated in conformity with a withdrawing amount of the conveyance unit 9 and necessitates a measure for preventing the wiring from getting caught when the conveyance unit 9 is inserted and withdrawn. On the other hand, this embodiment is free from the above problems since the coil shaft 10*b* and the circuit board 10*d* are withdrawn from the main body of the image forming apparatus 100 together with the conveyance unit 9.

As described above, in this embodiment, the operation can be easily performed to the coil shaft 10*b* and the circuit board 10*d* exposed at the outer side of the image forming apparatus 100 by considering a suitable coping strategy while looking at the coil shaft 10*b* and the circuit board 10*d* at a close range to confirm a troubled position or a position where a problem has occurred. Since the coil shaft 10*b* and the circuit board 10*d* are both fixedly attached to the conveyance unit 9 at this time, it is not necessary to make the wiring particularly longer in conformity with a sliding movement of the conveyance unit 9 and to consider a complicated layout of the wiring.

Normally, the fixing unit 10 and its peripheral devices are in a high-temperature state immediately after a printing operation. In this embodiment, since the coil shaft 10*b* can be directly looked at during the operation, there is quite a lower possibility that the operator touches a high-temperature portion as compared to the case where he performs the operation by touch.

Although the conveyance unit 9 and the fixing unit 10 are detachably supported in the above embodiment, a withdrawable unit different from the conveyance unit 9 may be so supported as to be withdrawable from the main body 100B of the image forming apparatus 100. In this case, the withdrawable unit does not particularly include the conveyance roller 9*c* and the conveyance belt 9*d* and only the fixing unit 10 is detachably supported in the withdrawable unit.

Further, although the heating roller 10*a* adopting the induction heating method is illustrated in the foregoing embodiment, according to the present invention, a heating roller may be heated by a heat source such as a halogen lamp. In this case, a temperature raising device for heat generation such as a halogen lamp is mounted on the conveyance unit 9 instead of the coil shaft 10*b*.

Second Embodiment

Figure 13A:
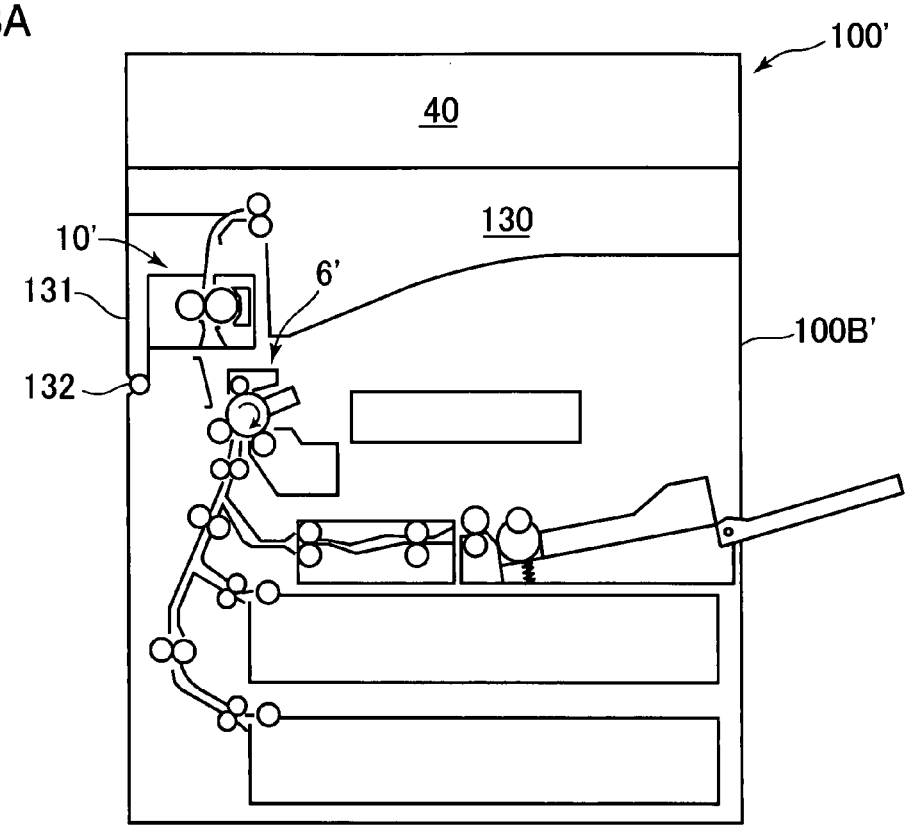
FIGS. 13A and 13B are schematic sectional views showing a construction of an image forming apparatus according to another embodiment of the invention.
Figure 13B:
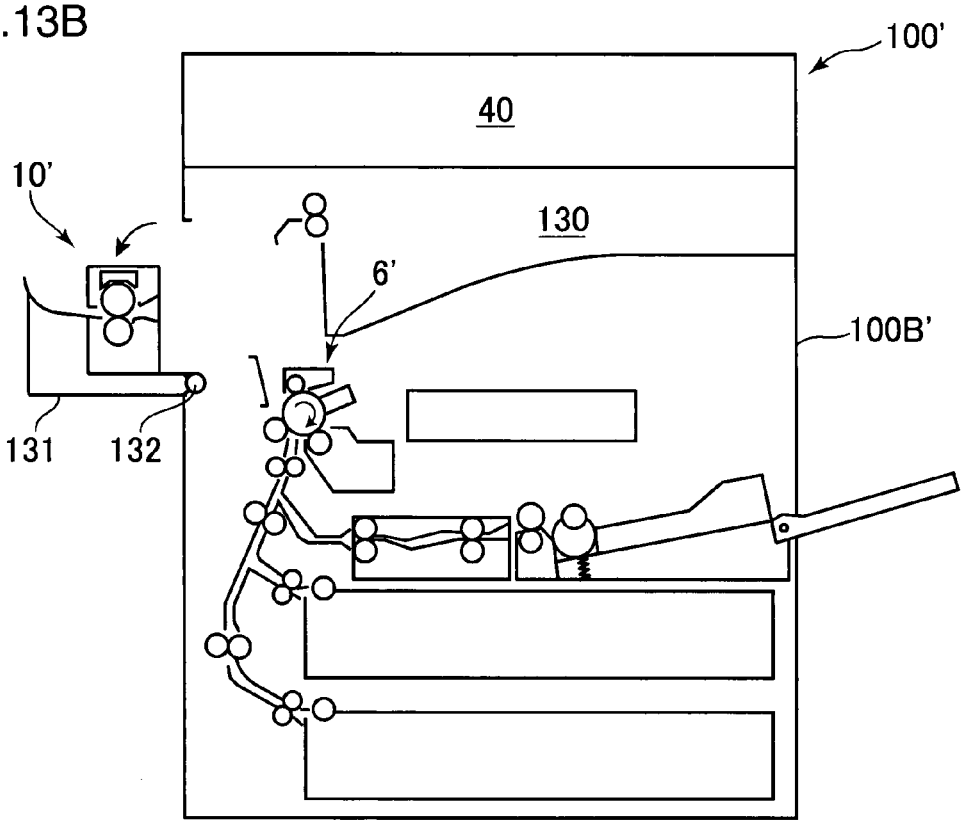

FIGS. 13A and 13B are schematic sectional views showing a construction of an image forming apparatus 100' according to a second embodiment of the invention. The image forming apparatus 100' is of the so-called discharge-in-body type. Specifically, a sheet discharge portion 130 is arranged below a document reader 40 provided on a top of a main body 100B'. The main body 100B' is provided with an image forming assembly 6' and a fixing unit 10' therein. The image forming assembly 6' and the fixing unit 10' have substantially the same construction as those described in the first embodiment.

In the first embodiment, the fixing unit 10 is mounted on a conveyance unit 9, and is exposed to the outside by slidingly withdrawing the conveyance unit 9. In the second embodiment, alternatively, the fixing unit 10' is detachably mounted on a unit cover 131 (i.e., withdrawable unit) which is provided on a side of the main body 100B'.

The unit cover 131 is attached to the side of the main body 100B' by a hinge 132, and is shiftable from a closed posture shown in FIG. 13A to an opened posture shown in FIG. 13B, and vice versa. The fixing unit 10' is exposed to the outside by bringing the unit cover 131 into the opened posture.

Figure 14A:
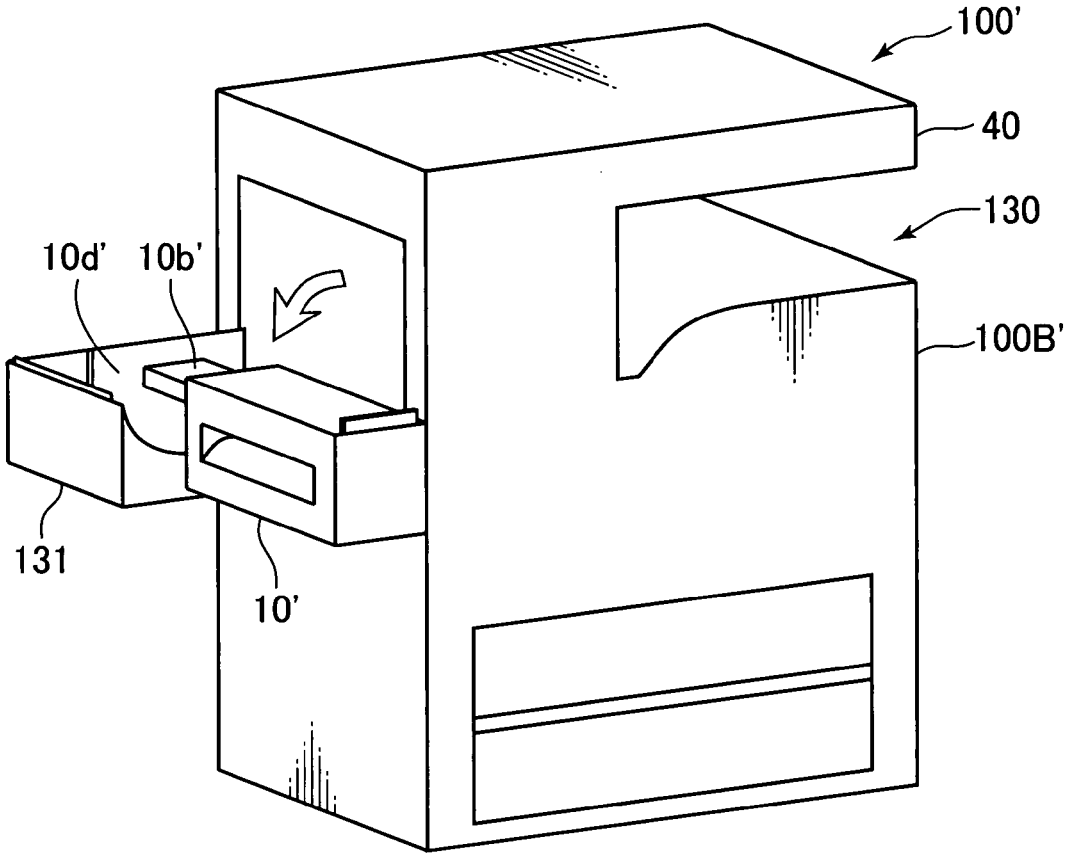
FIG. 14A is a perspective view of the image forming apparatus.
Figure 14B:
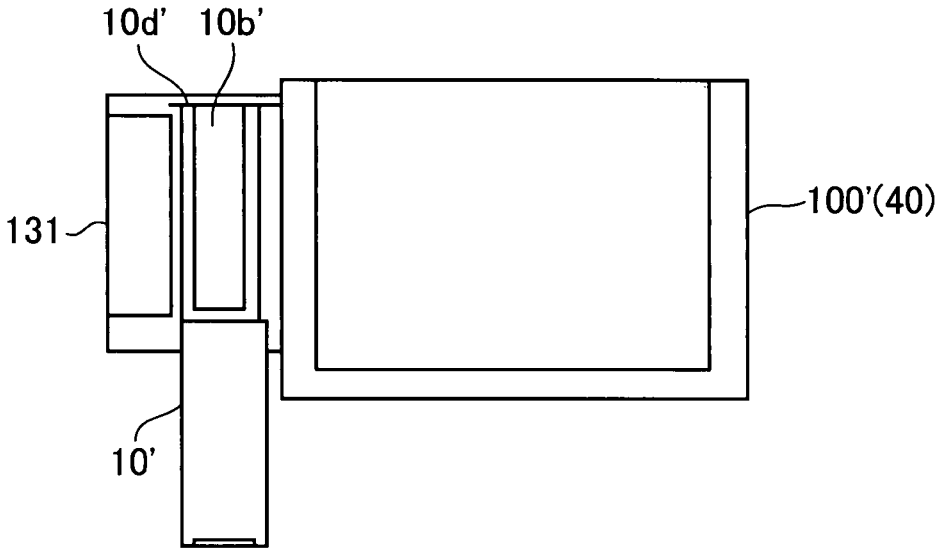
FIG. 14B is a top plan view of the image forming apparatus.

FIGS. 14A and 14B are respectively a perspective view and a top plan view of the image forming apparatus 100', and illustrate a withdrawing of the fixing unit 10' from the unit cover 131 in the opened posture. The unit cover 131 is attached with a coil shaft 10*b*' serving as a temperature raising device and a circuit board 10*d*'.

In the second embodiment, the coil shaft 10*b*' is fixedly attached to the unit cover 131 by a mounting portion different from the fixing unit 10'. Accordingly, the operator brings the unit cover 131 into the opened posture, detaches the fixing unit 10'. Consequently, the operator can easily perform the operation for the maintenance, the inspection and the like to the exposed coil shaft 10*b*' and the circuit board 10*d*' while looking at them closely.

(Modification)

Although the heating member and the pressure member of the fixing unit are illustrated as roller members in the foregoing embodiments, they may be constituted by a combination of a roller and an endless belt. Various modified fixing units are described below.

(1) Heat Roller Arrangement

Figure 7:
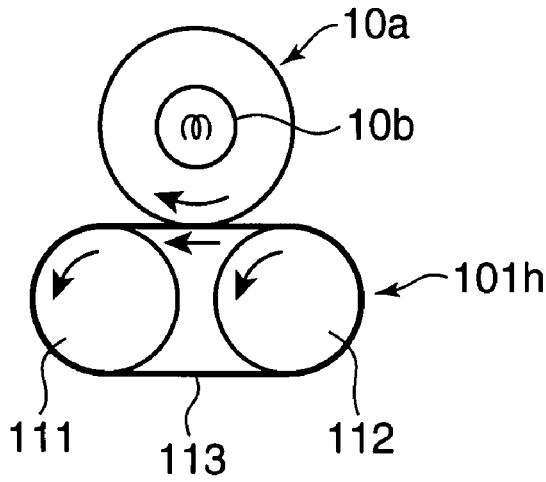
FIGS. 7 to 12B are schematic diagrams showing a construction of other exemplary fixing units.

In the case that the heating member of the fixing unit is a roller-shaped member, the pressure member may be an endless belt or film. FIG. 7 is a diagram showing an example using a belt-shaped pressure member 101*h*. This pressure member 101*h* is formed by mounting a belt 113 between a pair of rollers 111 and 112, and turns while having the outer circumferential surface of its middle part held in contact with the heating roller 10*a*, thereby forming a nip for nipping a sheet at its contact part with the heating roller 10*a*.

Figure 8:
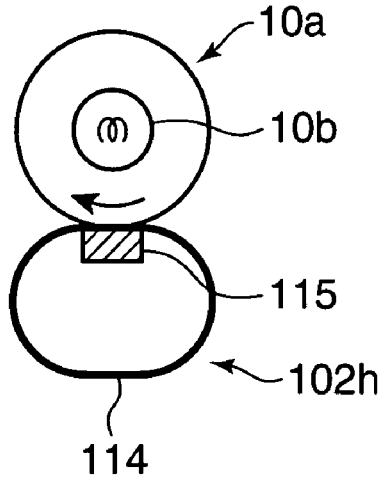

FIG. 8 is a diagram showing an example using a film-shaped pressure member 102*h*. A film 114 has the inner circumferential surface thereof supported on a pad 115 while being driven by the rotation of a drive roller. In such a state, the film 114 forms a nip between the outer circumferential surface thereof and the heating roller 10*a* by turning in contact with the heating roller 10*a*.

(2) External Heating Arrangement

Figure 9:
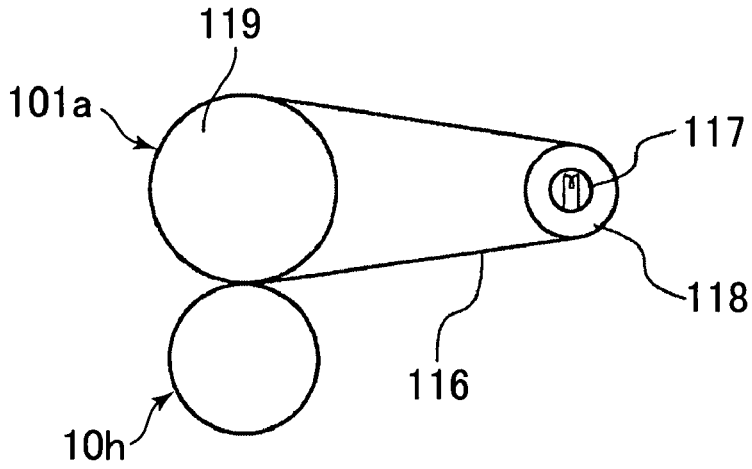

The heating member can fulfill its function as the fixing unit by being indirectly heated from the outside to increase temperature even if it is not a heat source itself. FIG. 9 is a diagram showing a heating member 101*a* using an endless heating belt 116. This heating member 101*a* is formed by mounting a heating belt 116 between a heating roller 118 having a halogen heater 117 and the like built therein and a fixing roller 119. The heating belt 116 receives heat from the heating roller 118 and forms a nip between the outer circumferential surface thereof and the pressure roller 10*h* by turning in contact with the pressure roller 10*h* by means of the fixing roller 119.

Figure 10:
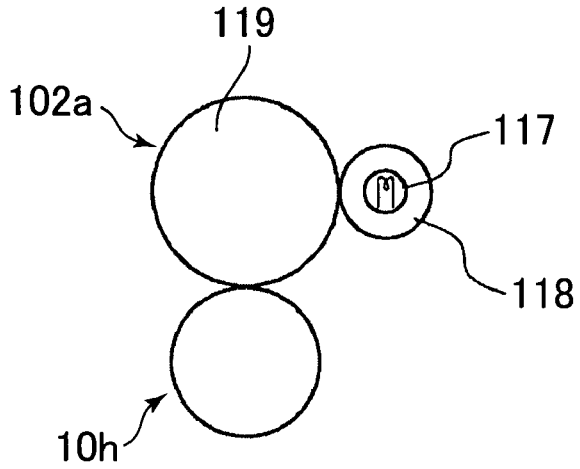

Alternatively, a heating member 102*a* may be adopted which heats the fixing roller 119 from the outside by bringing the heating roller 118 into contact with the outer circumferential surface of the fixing roller 119 as shown in FIG. 10.

(3) Heat Belt Arrangement

Figure 11:
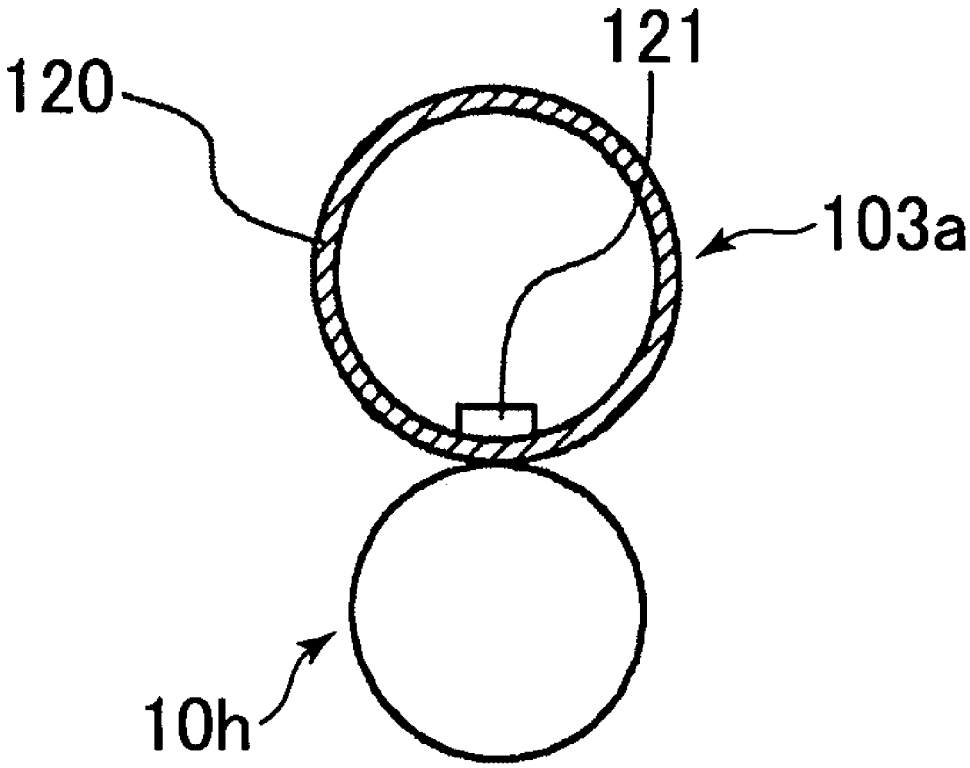

It is also possible to use an endless belt containing a metallic material as the heating member and to heat this metal-containing belt by an induction coil. FIG. 11 is a diagram showing such a heating member 103*a*. The heating member 103*a* includes a belt 120 and a ceramic heater array 121 (may be another heating element). The ceramic heater array 121 is arranged inside the heating belt 120 while being held on a holding member, and the heating belt 120 turns by being driven by an unillustrated drive roller to form a nip between the outer circumferential surface thereof and the pressure roller 10*h*.

(4) External Induction Coil Arrangement

Figure 12B:
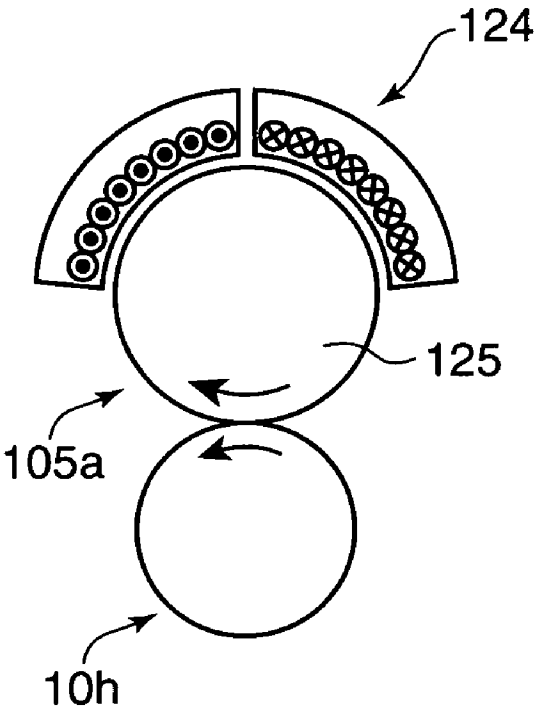
Figure 12A:
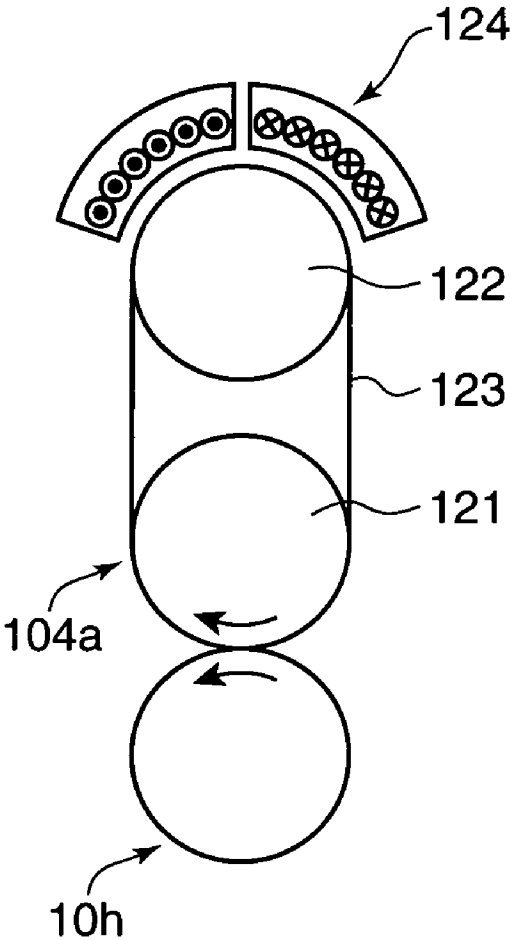

In the foregoing embodiments, the induction coil (coil shaft 10*b*) is arranged inside the heating roller 10*a*. However, it may be appreciated to arrange an induction coil in the vicinity of and along a peripheral surface of the heating roller 10*a*. FIGS. 12A and 12B respectively show heating rollers 104*a* and 105*a* which each are externally arranged with an induction coil 124.

In the fixing unit shown in FIG. 12A, a heating belt 123 is wound over a fixing roller 121 and a supporting roller 122. The induction coil 124 is arranged so as to enclose a peripheral surface of the supporting roller 122. In the fixing unit shown in FIG. 12B, the induction coil 124 is arranged so as to enclose a peripheral surface of an inductive fixing roller 125.

Besides, although the induction coil is wound inside the coil shaft in the foregoing embodiments, the induction coil may be wound on the outer circumferential surface of the coil shaft. Further, although the cylindrical coil shaft is taken as an example of the coil holding member in the foregoing embodiment, the specific shape of the coil holding member is not particularly limited. Furthermore, even if the coil shaft of the above embodiment is not used, the ferrite core of the induction coil may double as the holding member. Further, if the spiral induction coil has a certain rigidity, only the induction coil may be arranged inside the heating roller as a temperature raising device.

Although a copier, a complex machine and the like are given as examples of the image forming apparatus in the foregoing embodiments, the present invention can also be applied to a printer.

The specific embodiment described above mainly contains inventions having the following constructions.

An image forming apparatus comprises a main body; an image forming assembly accommodated in the main body and adapted for forming a toner image based on an image data and transferring the toner image to a recording sheet; a withdrawable unit accommodated in the main body in such a manner as to be withdrawable to the outside; a fixing unit detachably mounted on the withdrawable unit, including a heating member and a pressure member held in contact with the heating member with a specified pressing force and adapted for fixing the toner image to the recording sheet with heat from the heating member by conveying the recording sheet having the toner image transferred thereto while nipping it between the heating member and the pressure member; and a temperature raising device located in the vicinity of the heating member to raise the temperature of the heating member when the fixing unit is mounted on the withdrawable unit, wherein the temperature raising device includes a mounting portion different from that of the heating member, and is fixedly attached to the withdrawable unit and is kept attached to the withdrawable unit even if the fixing unit is separated from the withdrawable unit.

In this case, it is preferable that the heating member is a heating rotary member; and that the pressure member is a pressure rotary member and held in contact with the heating rotary member with a specified pressing force to form a nip portion and conveys the recording sheet having the toner image transferred thereto while nipping the recording sheet in the nip portion.

Also, an image forming apparatus comprises a main body; an image forming assembly accommodated in the main body and adapted for forming a toner image based on an image data and transferring the toner image to a recording sheet; a conveyance unit accommodated in the main body in such a manner as to be slidingly withdrawable to the outside and adapted for conveying the recording sheet having the toner image transferred thereto along a specified conveyance path; a fixing unit detachably mounted on the conveyance unit, including a heating rotary member and a pressure rotary member held in contact with the heating rotary member with a specified pressing force and adapted for fixing the toner image to the recording sheet with heat from the heating rotary member by conveying the recording sheet conveyed along the conveyance path while nipping it in the nip portion; an induction coil for causing the heating rotary member to generate an induction current; and a coil holding member including a mounting portion different from that of the heating rotary member, and mounted on the conveyance unit and located in the vicinity of the heating rotary member to hold the induction coil with the fixing unit mounted on the conveyance unit, the coil holding member being kept attached to the conveyance unit even if the fixing unit is separated from the conveyance unit.

According to the image forming apparatuses as above, the temperature raising device or the coil holding member is accommodated in the vicinity of the heating member during its operation (of fixing the toner image) and can fulfill its function of suitably raising the temperature of the heating member at this position.

On the other hand, the fixing unit is detachably mounted on the withdrawable unit or the conveyance unit withdrawable to the outside from the inside of the main body of the image forming apparatus. Thus, if the withdrawable unit or the conveyance unit is first withdrawn from the main body of the image forming apparatus, the fixing unit comes to be exposed at the outer side of the main body together with these units.

Subsequently, if the fixing unit is detached from the withdrawable unit or the conveyance unit, the temperature raising device or the coil holding member is relatively separated from the position in the vicinity of the heating member and remains in the withdrawable unit or the conveyance unit. Since the temperature raising device or the coil holding member is exposed at the outer side of the main body of the image forming apparatus in this case, an operation for the maintenance, inspection, part replacement and repair can be easily performed.

Rotary members such as rollers, endless belts can be used as the heating member and the pressure member. Particularly if the heating member is formed by a cylindrical roller, the temperature raising device or the coil holding member is arranged by being inserted into an inner space of the roller. In such a case, the temperature raising device or the coil holding member is accommodated inside the heating roller with the fixing unit mounted, and the temperature raising device or the coil holding member is relatively detached from the inside of the heating member to be exposed if the fixing unit is detached.

Accordingly, the maintenance operation of the fixing unit becomes quite easy. Further, it is not necessary to lay out wiring connected to the temperature raising device or the coil holding member in a complicated manner and necessary operations can be efficiently performed to the coil holding member and a current supplying portion.

In the above construction, it is preferable to further comprise a current supplying portion mounted on the conveyance unit to supply a current to the induction coil of the coil holding member. In this case, it is particularly preferable that the current supplying portion is a circuit board; that the conveyance unit includes a frame plate at the rear end in a sliding direction; and that the circuit board is mounted on the frame plate.

According to this construction, an operation for the maintenance, inspection, part replacement and repair can be easily performed to the current supplying portion as well as to the coil holding member. Further, since the coil holding member does not remain in the main body of the image forming apparatus unlike the prior art technology, it is not necessary to make the wiring longer in conformity with a withdrawing movement of the conveyance unit and to complicate the layout of the wiring.

In the above construction, it is preferable that the conveyance unit is withdrawable from the main body by being slid in a direction normal to a sheet conveying direction; that the fixing unit is separable from the conveyance unit by being slid in a direction which is normal to the sheet conveying direction and is the same direction as a withdrawing direction of the conveyance unit; and that the coil holding member extends in the direction normal to the sheet conveying direction in the conveyance unit and is inserted in a space formed inside the heating rotary member with the fixing unit mounted on the conveyance unit.

According to this construction, if the heating member and the pressure member are, for example, formed by rotary rollers or belts, the sliding direction of the fixing unit can coincide with directions of axes of rotation of the heating roller and the pressure roller or the heating belt and the pressure belt. Therefore, the heating member (roller, belt or the like) and the coil holding member are unlikely to interfere with each other at the time of attaching and detaching the fixing unit.

In this case, it is preferable that the conveyance unit includes a bottom plate provided with a guide rail extending in the direction normal to the sheet conveying direction; and that the fixing unit includes a supporting plate for supporting the heating rotary member and the pressure rotary member, the supporting plate being formed with a leg to be guided by the guide rail.

According to this construction, the operator can easily detach the fixing unit from the conveyance unit.

This application is based on patent application No. 2006-289750 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus, comprising:

a main body;

an image forming assembly accommodated in the main body and adapted for forming a toner image based on an image data and transferring the toner image to a recording sheet;

a withdrawable unit accommodated in the main body in such a manner as to be withdrawable to the outside;

a fixing unit detachably mounted on the withdrawable unit, including a heating member and a pressure member held in contact with the heating member with a specified pressing force and adapted for fixing the toner image to the recording sheet with heat from the heating member by conveying the recording sheet having the toner image transferred thereto while nipping it between the heating member and the pressure member; and a temperature raising device located in the vicinity of the heating member to raise the temperature of the heating member when the fixing unit is mounted on the withdrawable unit, wherein the temperature raising device includes a mounting portion different from that of the heating member, and is fixedly attached to the withdrawable unit and is kept attached to the withdrawable unit even if the fixing unit is separated from the withdrawable unit.

2. An image forming apparatus according to claim 1, wherein:

the heating member is a heating rotary member, and the pressure member is a pressure rotary member and held in contact with the heating rotary member with a specified pressing force to form a nip portion and conveys the recording sheet having the toner image transferred thereto while nipping the recording sheet in the nip portion.

3. An image forming apparatus, comprising:

a main body;

an image forming assembly accommodated in the main body and adapted for forming a toner image based on an image data and transferring the toner image to a recording sheet;

a conveyance unit accommodated in the main body in such a manner as to be slidingly withdrawable to the outside and adapted for conveying the recording sheet having the toner image transferred thereto along a specified conveyance path;

a fixing unit detachably mounted on the conveyance unit, including a heating rotary member and a pressure rotary member held in contact with the heating rotary member with a specified pressing force and adapted for fixing the toner image to the recording sheet with heat from the heating rotary member by conveying the recording sheet conveyed along the conveyance path while nipping it in the nip portion;

an induction coil for causing the heating rotary member to generate an induction current; and a coil holding member including a mounting portion different from that of the heating rotary member, and mounted on the conveyance unit and located in the vicinity of the heating rotary member to hold the induction coil with the fixing unit mounted on the conveyance unit, the coil holding member being kept attached to the conveyance unit even if the fixing unit is separated from the conveyance unit.

4. An image forming apparatus according to claim 3, further comprising a current supplying portion mounted on the conveyance unit to supply a current to the induction coil of the coil holding member.

5. An image forming apparatus according to claim 4, wherein:

the current supplying portion includes a circuit board;

the conveyance unit includes a frame plate at the rear end in a sliding direction; and the circuit board is mounted on the frame plate.

6. An image forming apparatus according to claim 3, wherein:

the conveyance unit is withdrawable from the main body by being slid in a direction normal to a sheet conveying direction;

the fixing unit is separable from the conveyance unit by being slid in a direction which is normal to the sheet conveying direction and is the same direction as a withdrawing direction of the conveyance unit; and the coil holding member extends in the direction normal to the sheet conveying direction in the conveyance unit and is inserted in a space formed inside the heating rotary member with the fixing unit mounted on the conveyance unit.

7. An image forming apparatus according to claim 6, wherein:

the conveyance unit includes a bottom plate provided with a guide rail extending in the direction normal to the sheet conveying direction; and the fixing unit includes a supporting plate for supporting the heating rotary member and the pressure rotary member, the supporting plate being formed with a leg to be guided by the guide rail.

* * * * *